US012723473B2

(12) United States Patent
Devireddi

(10) Patent No.: US 12,723,473 B2
(45) Date of Patent: Sep. 1, 2026

(54) EARTH BORING ROTARY BIT AND METHOD

(71) Applicant: SANDVIK MINING AND CONSTRUCTION TOOLS AB, Sandviken (SE)

(72) Inventor: Bala Balaji Devireddi, Pune (IN)

(73) Assignee: Sandvik Mining and Construction Tools AB, Sandviken (SE)

( * ) Notice: Subject to any disclaimer, the term of this patent is extended or adjusted under 35 U.S.C. 154(b) by 0 days.

(21) Appl. No.: 19/111,904

(22) PCT Filed: Sep. 15, 2023

(86) PCT No.: PCT/IB2023/059184

§ 371 (c)(1),
(2) Date: Mar. 14, 2025

(87) PCT Pub. No.: WO2024/057278

PCT Pub. Date: Mar. 21, 2024

(65) Prior Publication Data

US 2026/0098448 A1 Apr. 9, 2026

(30) Foreign Application Priority Data

Sep. 16, 2022 (IN) ..... 202221052989

(51) Int. Cl.
*E21B 10/16* (2006.01)

(52) U.S. Cl.
CPC ..... *E21B 10/16* (2013.01)

(58) Field of Classification Search
CPC ..... E21B 10/086; E21B 10/16; E21B 10/08
See application file for complete search history.

(56) References Cited

U.S. PATENT DOCUMENTS

| | | | | |
|---|---|---|---|---|
| 4,657,093 | A * | 4/1987 | Schumacher | E21B 10/16 175/353 |
| 4,741,406 | A * | 5/1988 | Deane | E21B 10/16 175/340 |
| 8,955,413 | B2 | 2/2015 | Bijai et al. | |
| 9,033,069 | B2 | 5/2015 | Zhang et al. | |
| 2007/0131457 | A1* | 6/2007 | McDonough | E21B 10/08 175/376 |
| 2011/0024197 | A1* | 2/2011 | Centala | E21B 10/08 175/353 |
| 2011/0162893 | A1* | 7/2011 | Zhang | E21B 10/20 175/428 |

FOREIGN PATENT DOCUMENTS

CN 102364031 B 7/2015

* cited by examiner

*Primary Examiner* — David Carroll
(74) *Attorney, Agent, or Firm* — Corinne R. Gorski

(57) ABSTRACT

An earth boring rotary bit and method of manufacturing the same is provided. The rotary bit is intended for rotary drilling and includes a bit body having three uniform legs and three uniform rolling cone cutters rotatably mounted to the legs. The three cone cutters have a uniform angular offset (Ao) and a linear offset (Lo). Further, the magnitude of the angular offset is 2-17° and the magnitude of the linear offset is 1.6-18 mm.

8 Claims, 9 Drawing Sheets

EARTH BORING ROTARY BIT AND METHOD

RELATED APPLICATION DATA

This application is a § 371 National Stage Application of PCT International Application No. PCT/IB2023/059184 filed Sep. 15, 2023, claiming priority to IN 202221052989 filed Sep. 16, 2022.

BACKGROUND OF THE INVENTION

The invention relates to an earth boring bit for rotary drilling.

The invention further relates to a method of forming a rotary bit.

In mines and at other work sites different type of rock drilling rigs are used for drilling drill holes. In rotary drilling a drilling tool comprising one or more drill pipes are connected to a rock drilling machine or unit and are rotated by a rotation device. At a distal end there is a rotary bit for cutting and crushing rock material. The rotary bit comprises several cutting cones arranged rotatably to a body of the rotating bit and comprising several cutting elements. Typically, all the cutting cones have different design so that cutting edges of the neighboring cutting cones do not collide when the cones are rotating. However, the use of cutting cones with different designs leads to unbalanced structure. There have been attempts to reach balanced rotary bits but no proper solutions have been found. Thereby, the known solutions have shown some disadvantages.

BRIEF DESCRIPTION OF THE INVENTION

An object of the invention is to provide a novel and improved rotary bit and a method for forming the same.

An idea of the disclosed solution is that an earth boring rotary bit comprises a bit body having a longitudinal bit axis and three uniform legs. Three uniform rolling cone cutters are rotatably mounted to the uniform legs of the bit body. The rolling cones are mounted to bearing journals and are provided with rotational axis around which they can rotate. The cone cutters have angular offsets between the rotational axis and the bit axis, whereby the rotational axis of the cone cutters do not intersect the bit axis. The cone cutters also have linear offsets defining distances between projections of the rotational axis of the cone cutters and lines being parallel to the mentioned projections and intersecting the bit axis. The angular and linear offsets are uniform for all three cone cutters. Magnitude of the angular offset is 2-17° and magnitude of the linear offset is 1.6-18 mm. Further, diameter of the rotary bit is 6-16 inches (152.4-406.4 mm).

In other words, the disclosed solution uses the uniform structure and the specifically designed and relatively high offset values to provide balanced structure and to prevent interference between the cutting elements on adjacent cone cutters.

An advantage of the disclosed solution is that the angular and linear offsets are designed carefully so that no collision occurs in the tri-cone rotary bit even though the rotary bit has three uniform legs and cone cutters.

Employing uniform characteristics in the rotary bit is for achieving balanced rotary bits wherein the rotating masses are balance and no harmful centrifugal forces are generated. This way no extra loads directed to the structure of the drilling equipment occur. It has been noted that the balanced feature has a positive effects also for efficiency of the drilling and drilling costs.

A further advantage is that the disclosed structure is relatively simple and inexpensive to manufacture and service because of the uniform structure and because number of the rotating cutting cones is reduced since they are all similar.

The disclosed solution with the high offset values allow use of cutting elements which protrude sufficiently for providing good cutting capability for the rotary bit.

The three uniform cones have the same rotation speed during the drilling which is beneficial. When the legs and the cones are non-uniform, then there exist different rotation speeds for each cone.

The cutting elements are arranged such that each row overlaps with adjacent cone row making this cutting structure effective. Journals on the legs are placed using combination of linear offset and an angular offset. This arrangement allows all three cones to revolve freely without interfering with adjacent cones.

According to an embodiment, the disclosed rotary bit is designed especially to be used in drilling soft formations or soil layers.

According to an embodiment, the cutting cones of the disclosed rotary bit are provided with aggressively protruding cutting elements, whereby the disclosed rotary bit can provide high penetration rate in soft formations and soil layers.

According to an embodiment, the mentioned values of the angular and linear offsets are dependent on projection on cutting elements (inserts or tooths) on the cones. The higher is the value of the projection the greater are values of the angular and linear offsets inside the mentioned ranges.

According to an embodiment, the disclosed tri-cone rolling cutter drill bit has uniform characteristics, whereby the tri-cone rotary bit is balanced. The uniform characteristics means that the three legs of the bit body are similar, the three cone cutters are similar, the offsets are similar for each cone cutter, and that the tree cone cutters and the legs are evenly distributed on the rotary bit i.e., they have similar spacing between them. Further, in the uniform cone cutters number of cutting elements are the same, locations and orientations of the cutting elements are the same, and shapes of bodies of the cone cutters are also similar.

According to an embodiment, the cone cutters comprise a plurality of hard metal cutting elements inserted on conical surfaces of the cone cutters and protruding from the conical surfaces. In other words, the inserts are made of different material than a basic body of the cone cutter.

According to an embodiment, the hard metal cutting elements are tungsten carbide inserts.

According to an embodiment, the hard metal cutting elements are press-fit in holes drilled in conical cutting cones so that they partly protrude outwardly.

According to an embodiment, the inserts are provided with round cross-sections and have insert diameter TCI Ø. The linear offset Lo can be dimensioned in accordance with the following formula $Lo \geq 0.4 * TCI Ø$. Thus, the linear offset Lo is dependent on the insert diameter TCI Ø. Further, the angular offset Ao can be dimensioned based on the calculated linear offset Lo and in accordance with the following formula $Ao \geq 0.5 * Lo$. When the offsets are dimensioned by means of these formulas, then there is enough clearance between the inserts of neighboring cutting cones. The formulas provide minimum offsets which means that the offset values can be greater if needed. The mentioned formula is developed and based on tests and empirical studies.

According to an embodiment, the cross-sectional diameter of the insert is 12-16 mm.

An example of the determination of the offsets:

bit diameter is 9"

diameter of the insert is 14 mm TCI Ø linear offset Lo: 0.4*14=5.6 mm, whereby the calculated linear offset Lo is within the proposed range of 1.6-18 mm angular offset Ao: 0.5*5.6=2.3°, whereby the calculated angular offset Ao is within the proposed range of 2-17°.

According to an embodiment, the cone cutters comprise a plurality of milled cutting teeth formed on conical surfaces of the cone cutters and protruding from the conical surfaces. In other words, the cutting elements are teeth, which are milled on the cutting cones and are of same base material as a body of the cutting cone. However, the teeth may be coated or treated with different techniques for improving their properties against wearing, for example.

According to an embodiment, the cutting elements are teeth formed on the cutting cones and each of the milled cutting teeth have uniform tooth width Tw at an outer end of the tooth. The linear offset Lo can be dimensioned in accordance with the following formula Lo≥0.4*Tw. Thus, the linear offset Lo is dependent on the tooth width Tw. Further, the angular offset Ao can be dimensioned based on the calculated linear offset Lo and in accordance with the following formula Ao≥0.5*Lo. When the offsets are dimensioned by means of these formulas, then there is enough clearance between the inserts of neighboring cutting cones. The formulas provide minimum offsets which means that the offset values can be greater if needed. The mentioned formula is developed and based on tests and empirical studies.

According to an embodiment, the width of the tooth is 12-16 mm. This width value is defined at a top of the tooth and represents minimum width of the tooth.

According to an embodiment, the rolling cone cutters comprise a body made of steel material and an outer surface of the body is provided with at least one abrasive resistance layer.

According to an embodiment, the body of the cone cutter has case carburizing surfaces on the milled cutting elements.

According to an embodiment, the body of the cone cutter has a coating made of abrasive resistance material.

According to an embodiment, the rolling cone cutters are provided with plain surfaces between cutting elements protruding from their outer surfaces. In other words, the rolling cone cutters are without any grooves between the cutting elements. Since grooves, or intermeshing grooves, are not needed, the structure may be more rigid as compared to solutions which need to be provided with the grooves for avoiding the cutting edges of the neighboring rolling cone cutters to collide. In solutions, where the cutting elements are made of inserts, there is more supporting base material surrounding the inserts, whereby proper support is provided for the inserts.

According to an embodiment, the disclosed solution is utilized in rotary drilling wherein no impact devices are utilized in the drilling process.

According to an embodiment, the disclosed solution relates to a method of forming an earth boring rotary bit. The method comprises: providing an elongated bit body having a longitudinal bit axis; providing the bit body with three uniform legs; mounting three uniform rolling cone cutters rotatable to the three legs; arranging the rolling cone cutters to be rotatable around rotational axis; providing the cone cutters with angular offsets between the rotational axis and the bit axis so that the rotational axis of the cone cutters do not intersect the bit axis; and providing the cone cutters with linear offsets defining distances between projections of the rotational axis of the cone cutters and lines being parallel to the mentioned projections and intersecting the bit axis. The method further comprises: implementing uniform angular and linear offsets for all the three cone cutters; dimensioning magnitude of the angular offset to be 2-17° and magnitude of the linear offset to be 1.6-18 mm; and using rotary bits with 6-16 inches (152.4-406.4 mm) diameter.

The above disclosed embodiments may be combined to form suitable solutions having those of the above features that are needed.

BRIEF DESCRIPTION OF THE FIGURES

Some embodiments are described in more detail in the accompanying drawings, in which.

For the sake of clarity, the figures show some embodiments of the disclosed solution in a simplified manner. In the figures, like reference numerals identify like elements.

DETAILED DESCRIPTION OF SOME EMBODIMENTS

Figure 1:
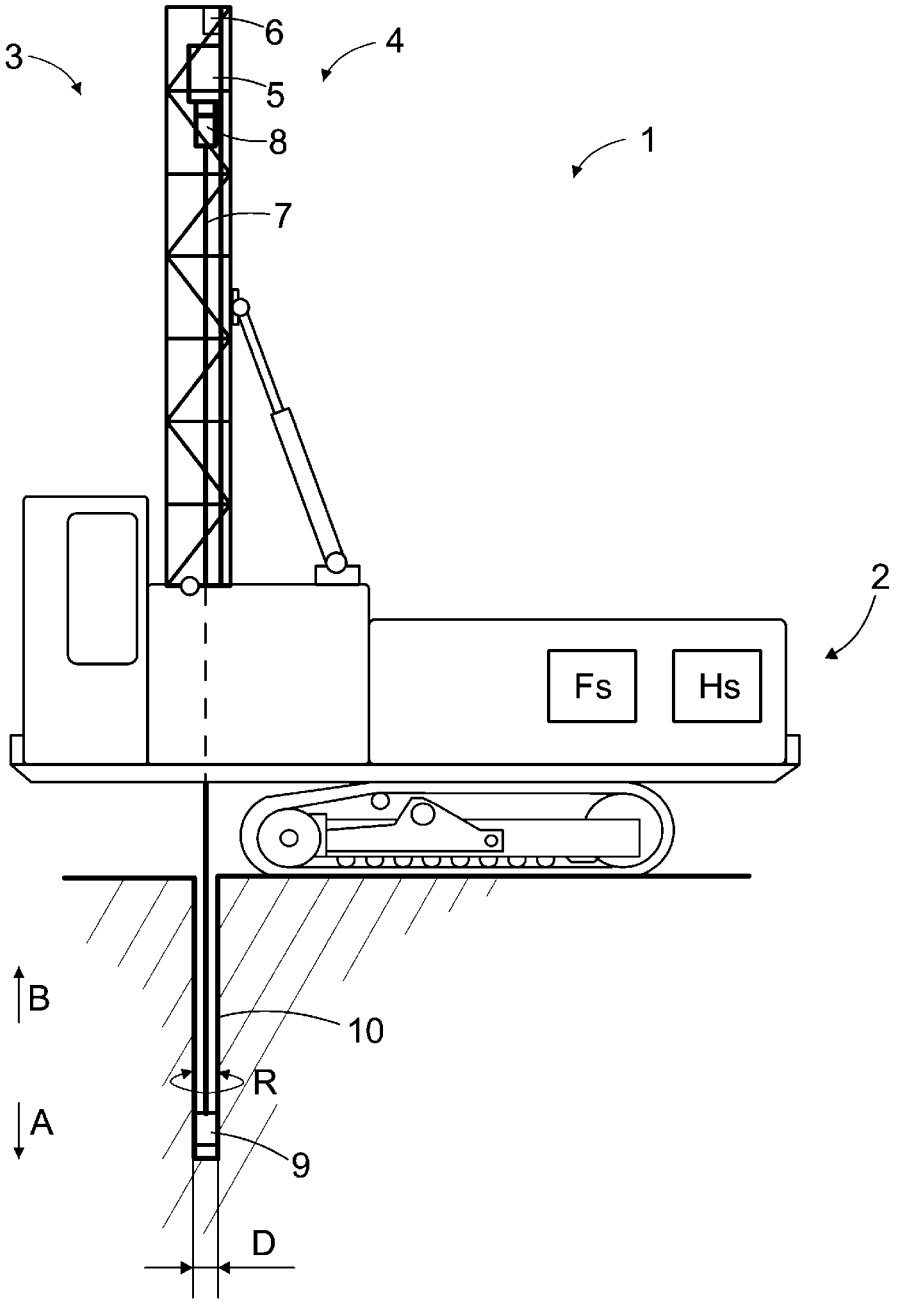
FIG. 1 is a schematic side view of a surface drilling rig intended for rotary drilling.

FIG. 1 shows a rock drilling rig 1 intended for surface drilling. The rock drilling rig 1 comprises a movable carrier 2 and at least one drilling mast 3 connected to the carrier 2. The mast 3 is provided with a drilling unit 4 provided with a rotating head 5 supported on the mast 3 and being movable in a drilling direction A and return direction B by means of a feed device 6. The rotating head 5 is connected to a drilling tool 7 by means of a sub-assembly 8. The drilling tool 7 is shown in a simplified manner for clarity reasons. The drilling tool 7 comprises one or more tubular elongated drill tube assemblies and a rotary bit 9 at its distal end. Diameter of the rotary bit 9 is typically 6-16 inches. The rotating head 5 rotates R the drilling tool 7 around its longitudinal axis and the drilling tool 7 is simultaneously fed towards a rock surface being drilled. This is known as rotary drilling method. Drilling cuttings are flushed by feeding flushing fluid from a flushing system Fs via the drilling tool 7 to a drill hole 10 being drilled so that the drilling cuttings are flushed away from the drill hole 10. The drilling unit 4 may be hydraulic whereby it may be connected to a hydraulic system Hs.

Figure 2:
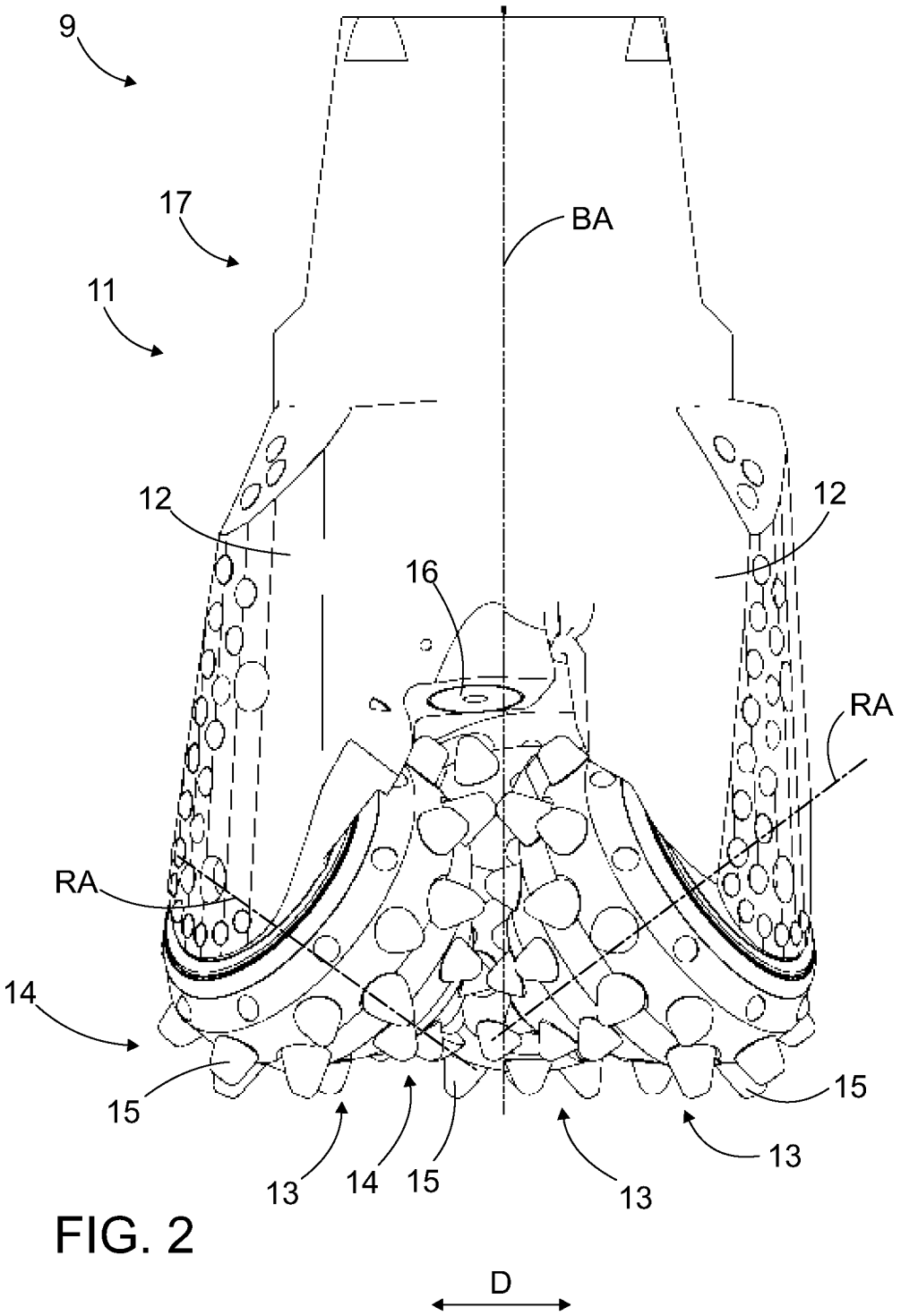
FIG. 2 is a schematic side view of an earth boring rotary bit.

FIG. 2 discloses a rotary bit 9 comprising a bit body 11 having a longitudinal bit axis BA and three uniform legs 12. Three uniform rolling cone cutters 13 are rotatably mounted to the legs 12 and are provided with rotational axis RA or bearing axis. The cone cutters 13 comprise several cutting elements 14, in this case the cutting elements 14 are hard metal cutting element inserts 15 inserted on conical surfaces of the cone cutters 13. The inserts 15 protrude from the conical surfaces. The cone cutters 13 are uniform and are mounted similarly to the legs 12. There may or may not be additional cutting inserts mounted on radial surfaces of the legs 12 too. For executing flushing one or more flushing openings 16 are arranged on the body 11. Further, at a second end of the body 11 there is a connecting portion 17 for mounting the rotary bit 9 to a drill tube. The connecting portion 17 includes typically a connecting thread.

Figure 3:
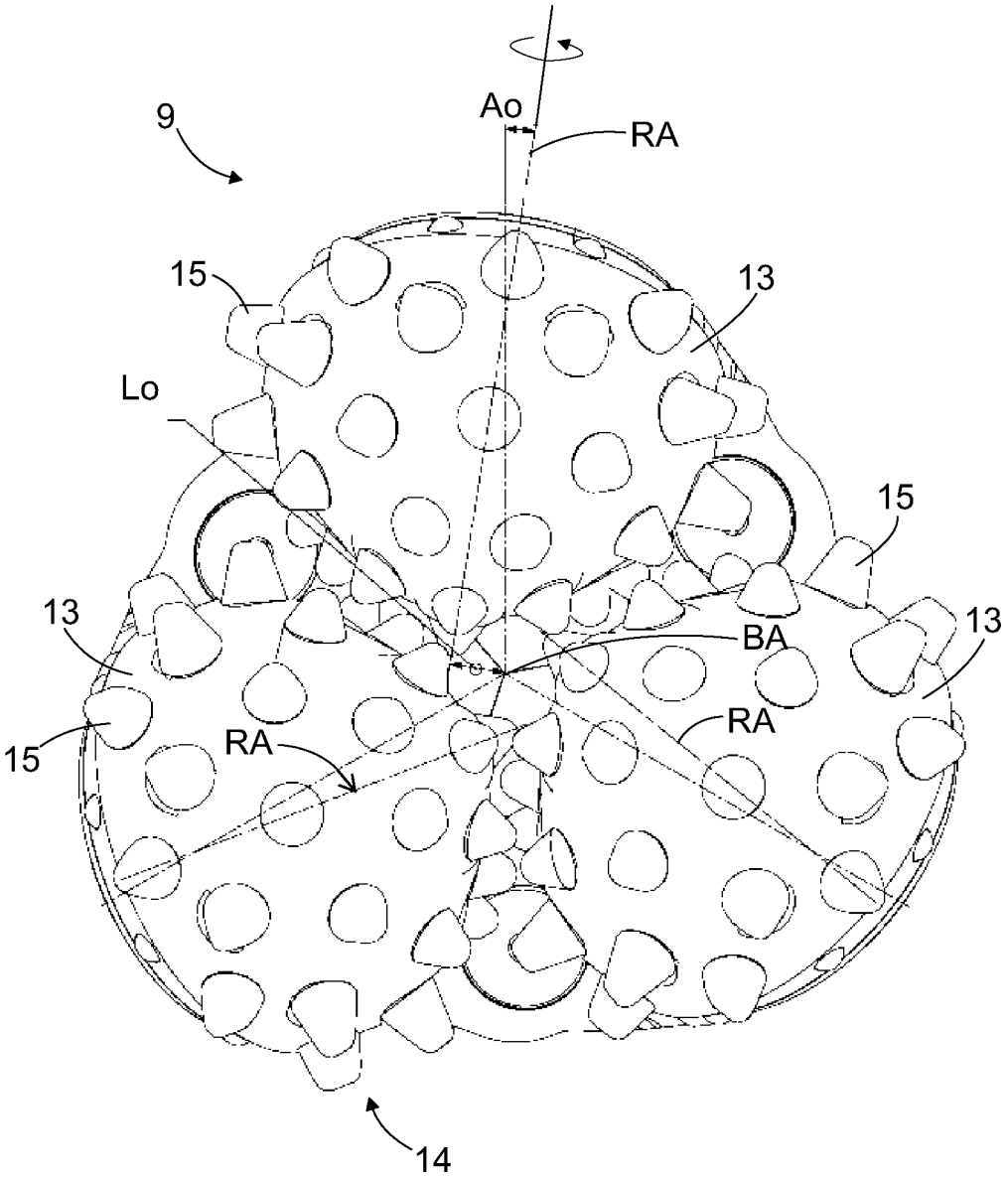
FIG. 3 is a schematic view of a rotary bit seen in longitudinal direction and from a side of a drill hole bottom.

FIG. 3 discloses a rotary bit 9 provided with three uniform cone cutters 13 arranged so that their hard metal cutting inserts 15 do not collide when the cone cutters 13 rotate because of rotation of the entire rotary bit 9. The cone cutters 13 are rotated around rotating axis RA which do not intersect with bit axis BA around which the entire rotary bit 9 rotates during the drilling. Thus, the cone cutters 13 have angular offsets Ao between the rotational axis RA and the bit axis BA. Further, the cone cutters 13 have linear offsets Lo defining distances between projections of the rotational axis RA of the cone cutters 13 and lines being parallel to the mentioned projections and intersecting the bit axis BA. The angular offsets Ao and linear offsets Lo are uniform for all three cone cutters 13 and their magnitudes are inside the ranges give in this document.

Figure 4:
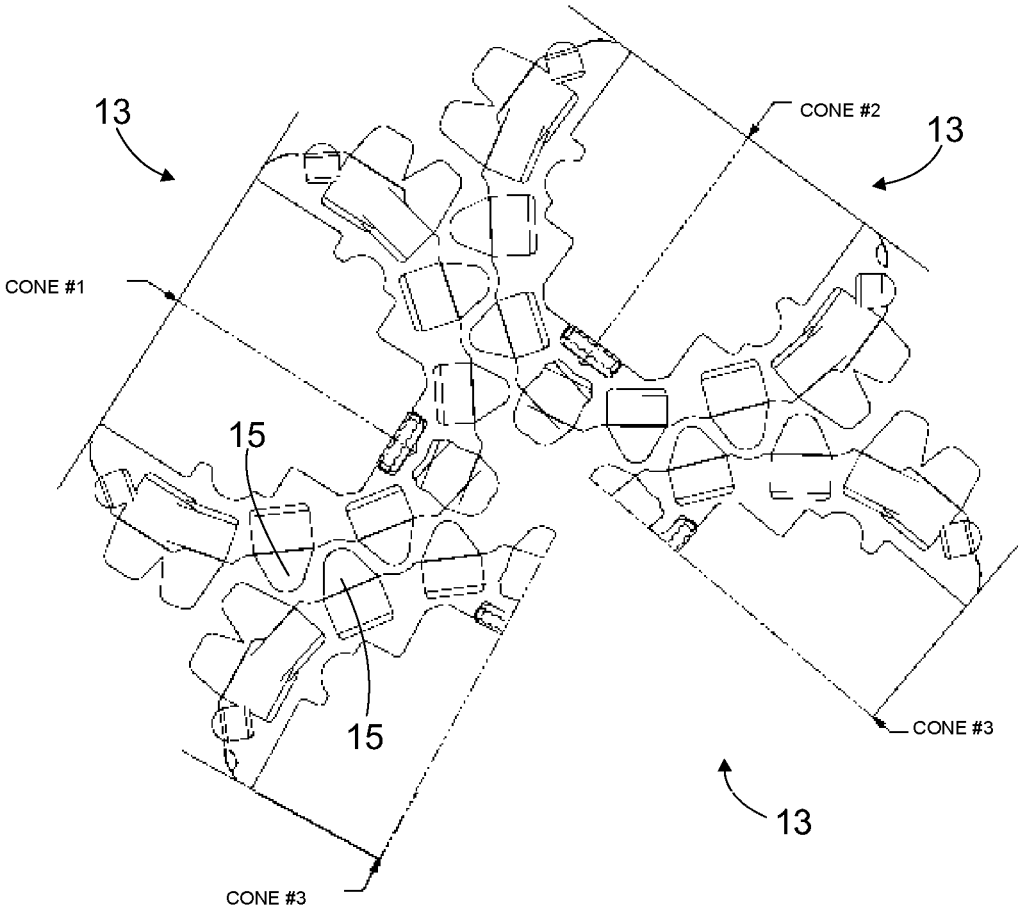
FIG. 4 is a schematic diagram showing how cutting elements of three cone cutters intermesh in relation to each other.

FIG. 4 illustrates that the inserts 15 do not collide when the cone cutters 13 are arranged in accordance with the features disclosed in this document.

Figure 5:
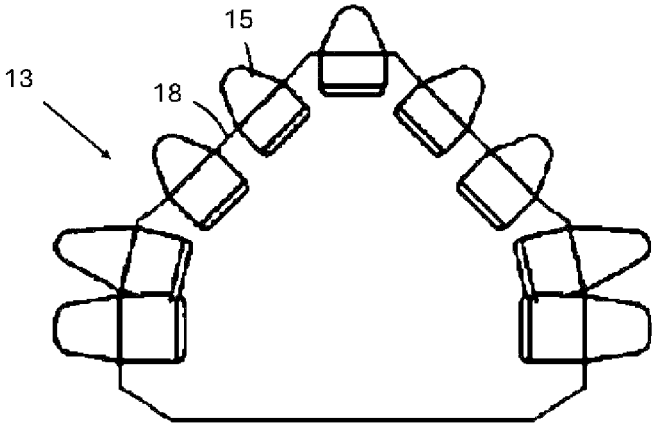
FIG. 5 is a schematic side view of a cone cutter provided with flat surfaces between cutting elements.

FIG. 5 shows that there is no need for any grooves between cutting inserts 15 of a cone cutter 13. That is because the cone cutters 13 are mounted in accordance with previous FIGS. 3 and 4 and can pass themselves without colliding and without requiring any grooves. Surfaces 18 between the inserts 15 can be flat.

Figure 6:
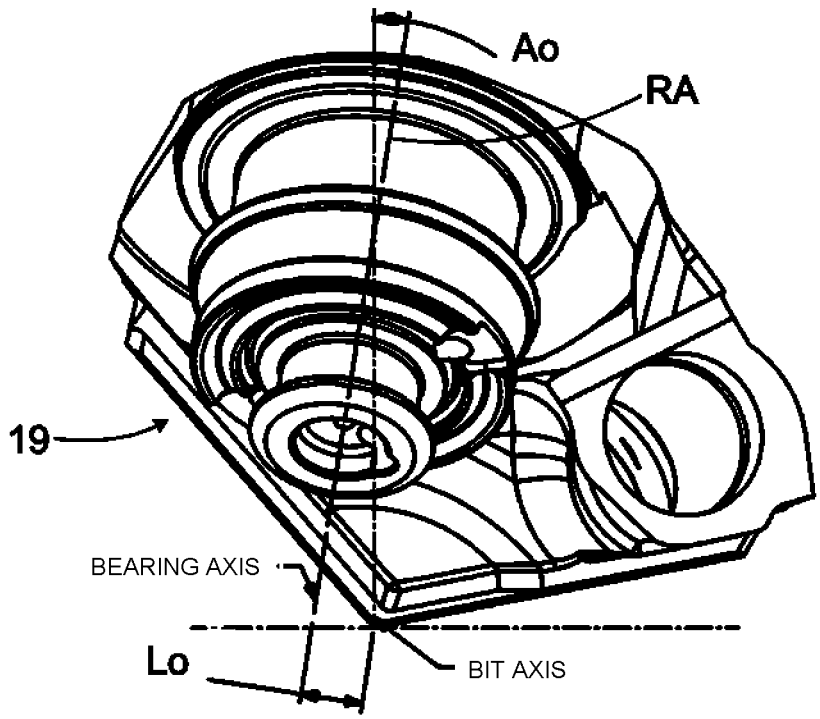
FIG. 6 is a schematic view of a bearing journal of a cone cutter.

FIG. 6 discloses a bearing arrangement or bearing journal 19 having rotating axis RA. A cone cutter can be mounted on the bearing journal 19 and can rotate freely.

Figure 7:
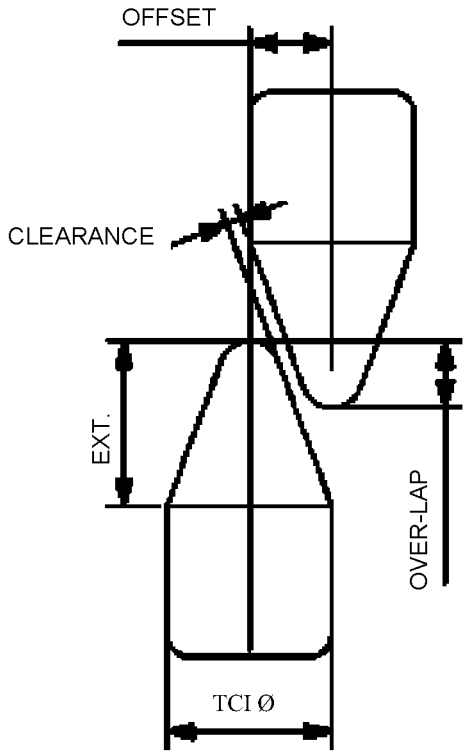
FIG. 7 is a schematic view of intermeshing cutting inserts of adjacent cone cutters.

FIG. 7 show two cutting inserts 15 of two neighboring cone cutters and the way they are positioned in relation to each other when the mentioned angular and linear offsets are in accordance with the present document. The heads of the inserts 15 have overlap and in lateral direction there is an offset. Between the flank surfaces there is a clearance.

Figure 8:
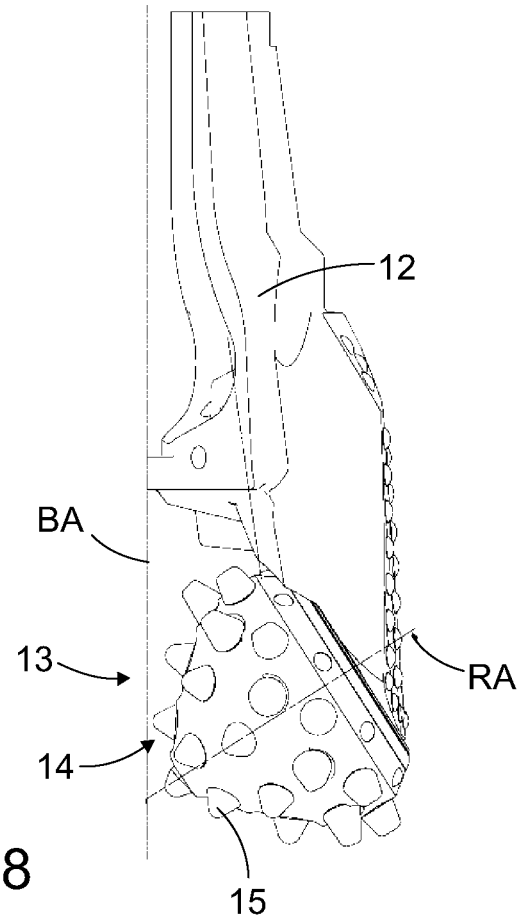
FIG. 8 is a schematic side view of a leg of a rotary bit provided with a cone cutter.
Figure 9:
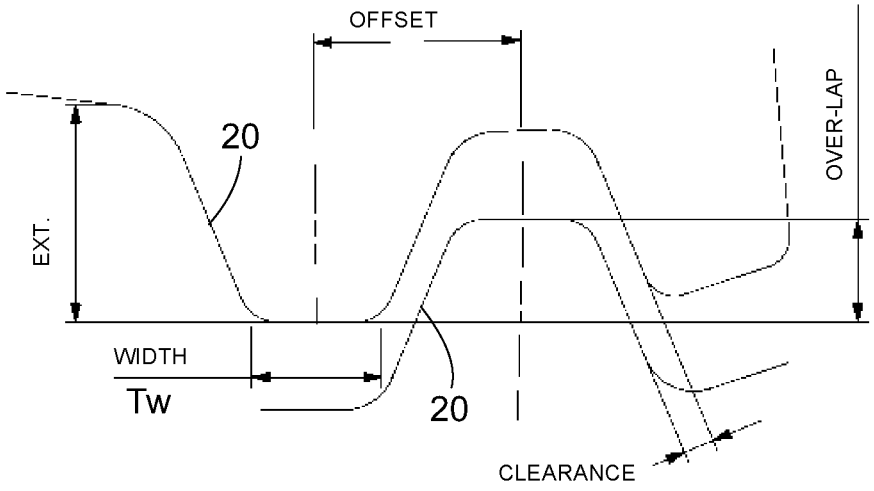
FIG. 9 is a schematic view of intermeshing cutting teeth of adjacent cone cutters.
Figure 10:
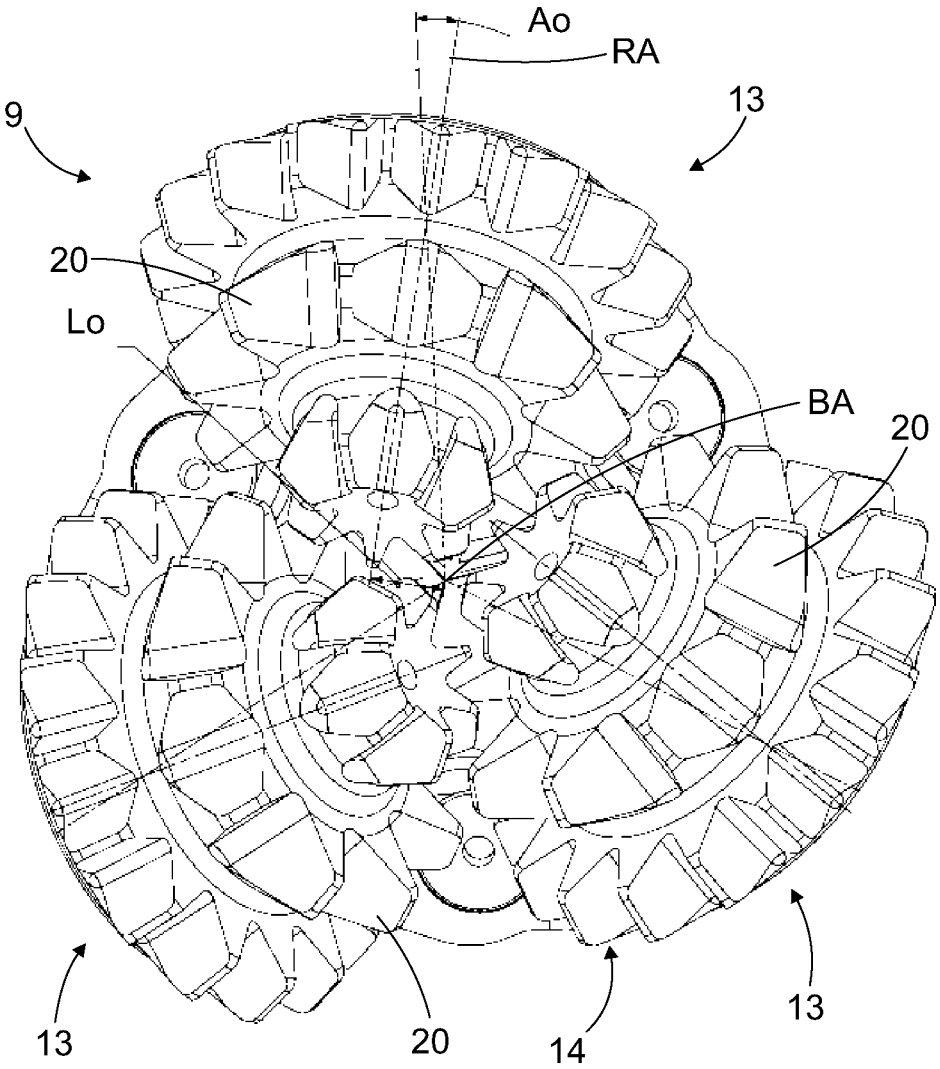
FIG. 10 is a schematic view of a rotary bit provided with milled teeth and seen in longitudinal direction and from a side of a drill hole bottom.
Figure 11:
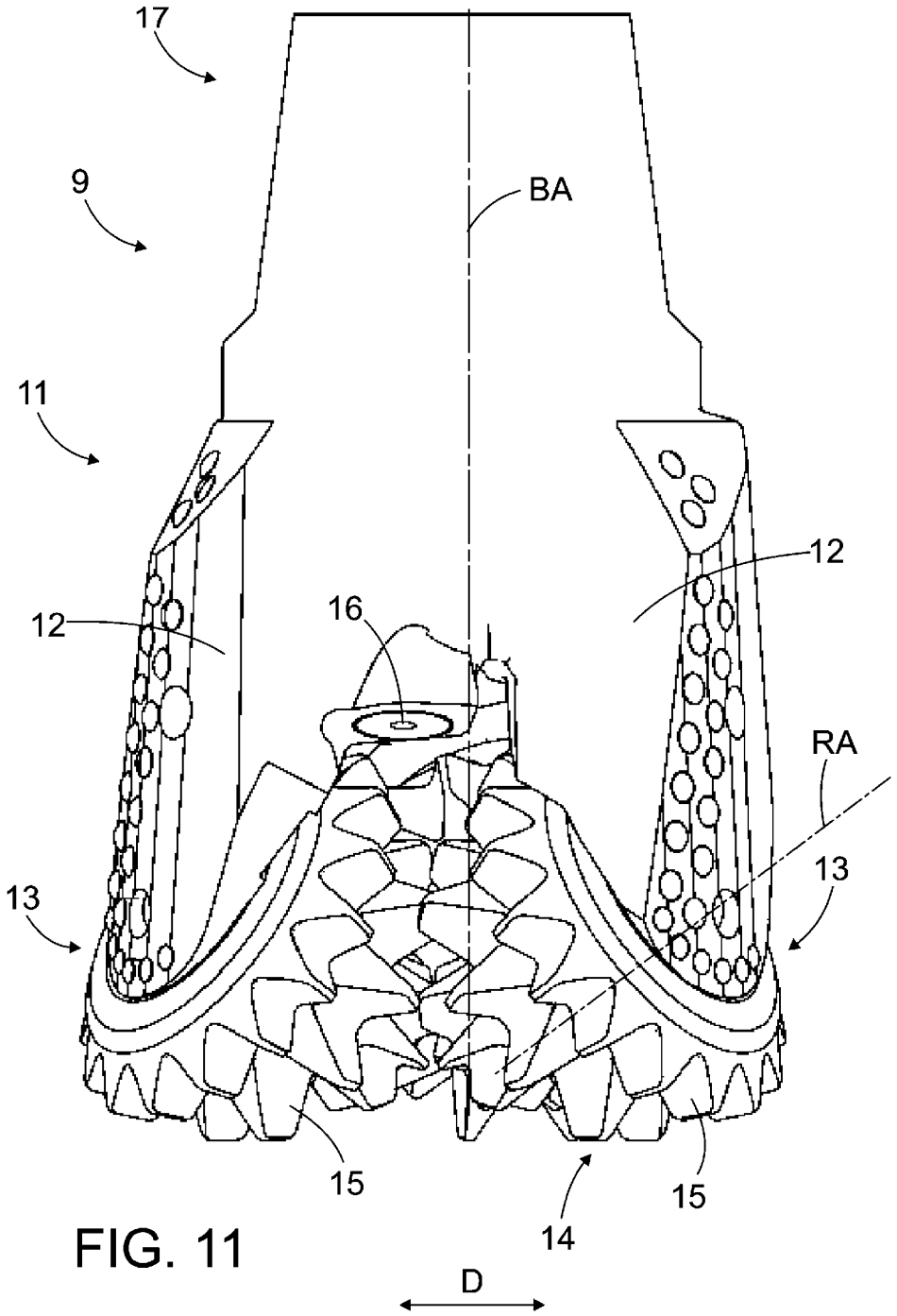
FIG. 11 is a schematic side view of a tricone rotary bit provided with machined cutting teeth.
Figure 12:
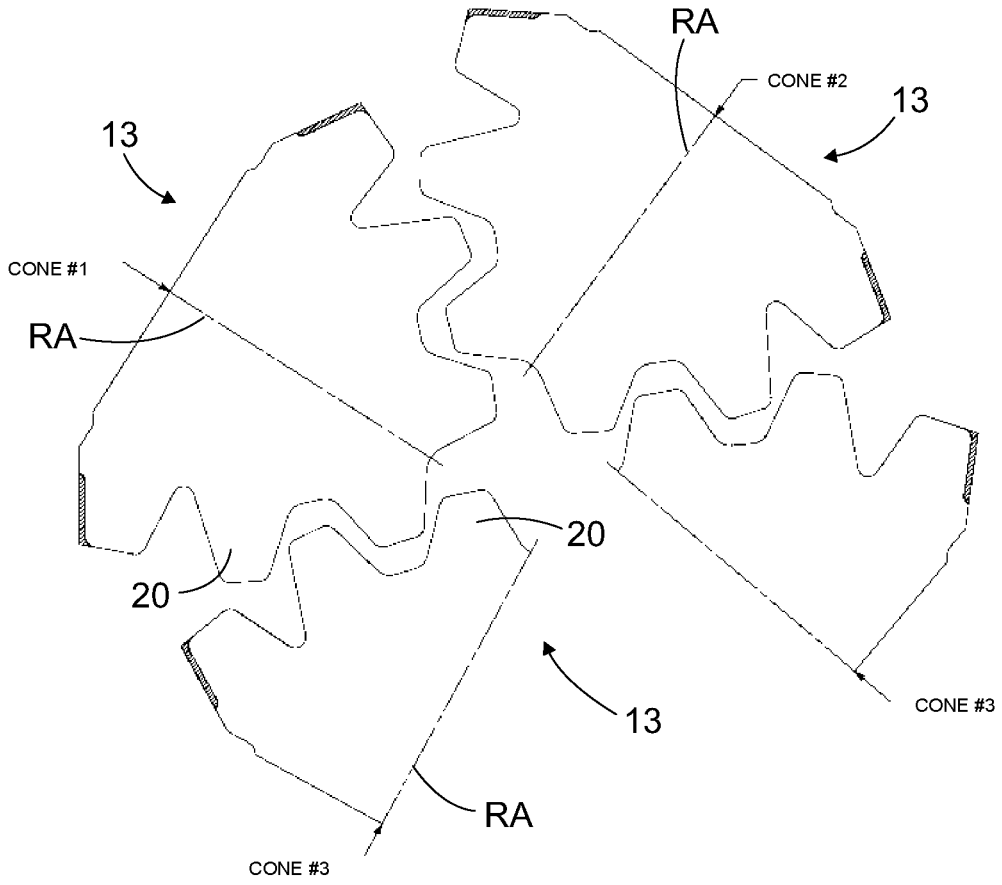
FIG. 12 is a schematic diagram showing how cutting teeth of adjacent cone cutters intermesh in relation to each other.

FIG. 8 discloses a leg 12 provided with a cone cutter 13 comprising several cutting elements 14.

FIGS. 9-12 disclose embodiments wherein all three cone cutters 13 are uniform and are provided with milled teeth 20. The teeth 20 have tooth width Tw as it is disclosed in FIG. 9. The cone cutters 13 are orientated in accordance with the features disclosed in this document whereby angular offsets Ao and linear offsets Lo occur inside disclosed ranges. Since the main features correspond to the structures disclosed in FIGS. 2-4, no detailed description of these features is needed.

The drawings and the related description are only intended to illustrate the idea of the invention. In its details, the invention may vary within the scope of the claims.

I claim:

1. An earth boring rotary bit comprising:

a bit body having a longitudinal bit axis and three uniform legs;

three uniform rolling cone cutters rotatably mounted to the legs and being provided with a rotational axis, wherein the cone cutters have angular offsets (Ao) between the rotational axis and the bit axis, whereby the rotational axis of the cone cutters do not intersect the bit axis, and wherein the cone cutters have linear offsets (Lo) defining distances between projections of the rotational axis of the cone cutters and lines being parallel to the projections and intersecting the bit axis, wherein the angular and linear offsets (Ao, Lo) are uniform for all three cone cutters;

wherein a magnitude of the angular offset (Ao) is 2-17° and a magnitude of the linear offset (Lo) is 1.6-18 mm, and wherein a diameter of the rotary bit is 6-16 inches.

2. The rotary bit as claimed in claim 1, wherein the cone cutters include a plurality of hard metal cutting element inserts inserted on conical surfaces of the cone cutters and protruding from the conical surfaces.

3. The rotary bit as claimed in claim 2, wherein the inserts are provided with round cross-sections and have insert diameters (TCI Ø);

and wherein the linear offset (Lo) is dimensioned in accordance with the following formula:

$$Lo \geq 0.4 * TCI\,\emptyset;$$

and wherein the angular offset (Ao) is dimensioned based on the calculated linear offset (Lo) and in accordance with the following formula:

$$Ao \geq 0.5 * Lo.$$

4. The rotary bit as claimed in claim 1, wherein each of the cone cutters include a plurality of milled cutting teeth (20) formed on conical surfaces of the cone cutters and protruding from the conical surfaces.

5. The rotary bit as claimed in claim 4, wherein each of the plurality of milled cutting teeth has a uniform tooth width (Tw) at an outer end of the tooth, and wherein the linear offset (Lo) is dimensioned in accordance with the following formula:

$$Lo \geq 0.4 * Tw;$$

and wherein the angular offset (Ao) is dimensioned based on the calculated linear offset (Lo) and in accordance with the following formula:

$$Ao \geq 0.5 * Lo.$$

6. The rotary bit as claimed in claim 1, wherein each of the rolling cone cutters includes a body made of a steel material and an outer surface of the body is provided with at least one abrasive resistance layer.

7. The rotary bit as claimed in claim 1, wherein each of the rolling cone cutters are provided with plain surfaces between cutting elements protruding from the outer surfaces.

8. A method of forming an earth boring rotary bit; the method comprising:

providing an elongated bit body having a longitudinal bit axis;

providing the bit body with three uniform legs;

mounting three uniform rolling cone cutters rotatably to the three legs;

arranging the rolling cone cutters to be rotatable around a rotational axis;

providing the cone cutters with angular offsets (Ao) between the rotational axis and the bit axis se such that the rotational axis of the cone cutters do not intersect the bit axis;

providing each of the cone cutters with linear offsets defining distances between projections of the rotational axis of the cone cutters and lines being parallel to the projections and intersecting the bit axis;

implementing uniform angular and linear offsets (Ao, Lo) for each of the three cone cutters;

dimensioning a magnitude of the angular offset (Ao) to be 2-17° and a magnitude of the linear offset (Lo) to be 1.6-18 mm; and using rotary bits with a 6-16 inches diameter.

* * * * *